US005134758A

United States Patent [19]

Christensen

[11] Patent Number: 5,134,758

[45] Date of Patent: Aug. 4, 1992

[54] NICHE CONSTRUCTION AND METHOD

[75] Inventor: Thomas E. Christensen, Pleasanton, Calif.

[73] Assignee: Christy Concrete Products, Inc., Fremont, Calif.

[21] Appl. No.: 639,670

[22] Filed: Jan. 7, 1991

[51] Int. Cl.[5] ..... A61G 17/00

[52] U.S. Cl. ..... 27/35; 52/134; 52/136; 52/137; 52/741

[58] Field of Search ..... 52/134–137, 52/741; 27/1, 35

[56] References Cited

U.S. PATENT DOCUMENTS 2,822,685 2/1958 Chandler et al. ..... 52/137
3,130,520 4/1964 Newman, Jr. ..... 52/135
3,596,419 8/1971 Jalbert ..... 52/137
3,978,627 9/1976 Booth ..... 52/136

*Primary Examiner*—Richard E. Chilcot, Jr.
*Attorney, Agent, or Firm*—Flehr, Hohbach, Test, Albritton & Herbert

[57] ABSTRACT

A niche construction comprised of a wall of reinforced concrete which has a surface with recesses formed therein which have openings which extend to the surface, box liners of non-combustible plastic material which have fiberglass fibers disposed therein, the liners disposed in said recesses, and an adhesive adherent to the liner and to said concrete disposed on the exterior surface of the liner and the interior of the recess and which forms a bond between the box liner and the reinforced concrete to prevent removal of the box liner.

7 Claims, 1 Drawing Sheet

NICHE CONSTRUCTION AND METHOD

This invention relates to a niche construction and method and more particularly to a niche construction and method which is vandal resistant.

Pre-cast concrete niches have heretofore been provided which have been installed indoors, outdoors in the ground, in columbariums, mausoleums and the like. However, it has been found that such pre-cast concrete niches have not been as vandal resistant as desired. There is therefore a need for a new and improved pre-cast niche construction.

In general, it is an object of the present invention to provide a niche construction and method which is vandal resistant.

Another object of the invention is to provide a niche construction and method in which the "Fibrelyte" liners cannot be removed from the pre-cast concrete without destruction of the liner.

Another object of the invention is to provide a niche construction which has an attractive appearance.

Another object of the invention is to provide a niche construction and method of the above character which is economical to construct.

Additional objects and features of the invention will appear from the following description in which the preferred embodiment is set forth in detail in conjunction with the accompanying drawing.

Figure 1:
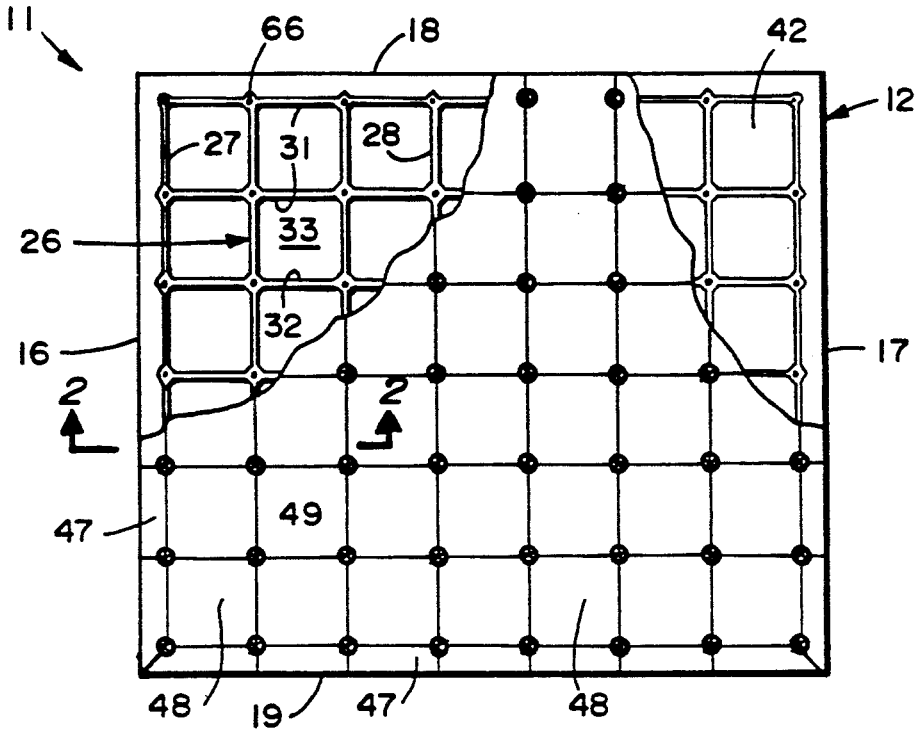
FIG. 1 is a front elevational view of a pre-cast niche construction incorporating the present invention and having certain portions broken away to show additional details.
Figure 2:
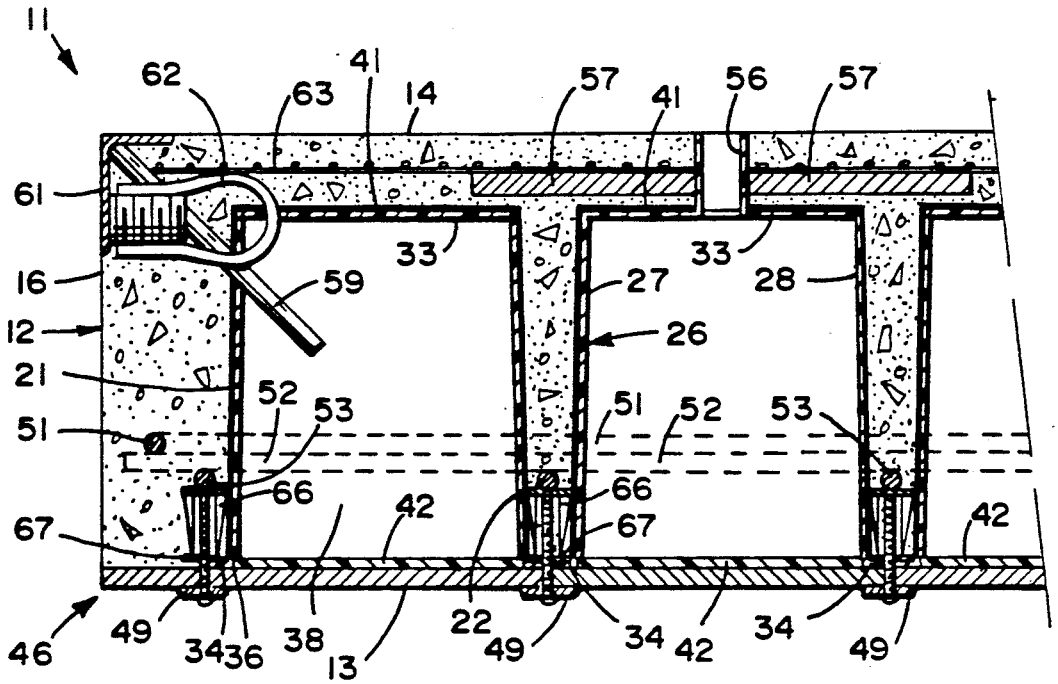
FIG. 2 is an enlarged cross sectional view taken along the line 2—2 of FIG. 1.

In general, the niche construction incorporating the present invention is comprised of a wall of reinforced concrete having a surface and having recesses formed therein. Box liners formed of a non-combustible bulk fiberglass reinforced plastic are disposed in said recesses and have openings therein opening through said surface of the wall. A two-part adhesive is disposed between the liner and the reinforced concrete wall to secure the box liners into the recesses to prevent removal of the same. A security shutter formed of reinforced fiberglass reinforced plastic is adapted to be mounted in the opening in the box liner and is adapted to be bonded to the box liner to provide a waterproof sealed space which can be utilized for saving cremation remains.

In the method for providing a niche construction, the fiberglass reinforced plastic liners are secured to a support table in spaced apart positions. Reinforcing is in then placed between and over the box liners. A two-part adhesive is then placed over the porous exterior surfaces of the box liners and high strength concrete mix is then poured over the box liners and the reinforcing and permitted to cure. Thereafter, the cured reinforced concrete is lifted from the table to expose the openings in the surface of the wall of the reinforced concrete which is provided by the box liners.

More particularly, as shown in the drawings, the niche construction 11 consists of a pre-cast reinforced concrete wall 12 having a suitable thickness as for example 9 inches and which is provided with the front surface 13, a rear surface 14 and side surfaces 16 and 17, as well as top and bottom surfaces 18 and 19. Box-like recesses 21 are formed in the wall 12 and have openings 22 which extend through the front surface 13. Box liners

26 are mounted in the recesses 21 in a manner hereinafter described. The box liners 26 are formed of Fibrelyte TM. Fibrelyte is a commercially available product comprised of a polyester pre-mix with fiberglass strands, resin, calcium carbonate and a dye to give the finished material a marble-like appearance. These materials are pre-mixed in bulk and then are molded into the desired shape by a suitable press, as for example a 60-ton press which utilizes steam for curing to cause the catalyst in the pre-mix to react.

The box liners 26 are square in cross section and can have suitable dimensions such as a width and height of 6 inches and a length or depth of 7½ inches. The box liners 26 are provided with sidewalls 27 and 28, top and bottom walls 31 and 32, rear wall 33 and a flange 34 extending around the front extremities of the sidewalls 27 and 28 and the top and bottom walls 31 and 32 to define a rectangular recess 36 and a front opening 37.

An adhesive layer 41 of the type hereinbefore described is provided on the outer surfaces of the box liner 26 and the surfaces of the reinforced concrete forming the box-like recesses 21 to form an intimate bond between the box liner 26 and the reinforced concrete to prevent removal of the box liner from the reinforced concrete wall 12. Security shutters 42 formed of the same Fibrelyte material as the box liners 26 are adapted to be mounted in the front openings 37 and secured in the rectangular recesses 36 to form watertight enclosed spaces or niches 43 in the box liners 26 by use of a suitable adhesive between the shutter 42 and the box liners 26.

The front surface 13 of the wall 12 can be provided with a facade 46 formed of a suitable material such as marble. The marble facade is comprised of trim pieces 47 extending around the outer margin of the wall with individual marble shutters 48 provided for each of the box liners 26 which are held in place by rosettes 49 in a manner hereinafter described.

The method for forming a niche construction 11 is comprised of the steps of utilizing a table (not shown) having a horizontal flat surface thereon. Box liners 26 of the type hereinbefore described are placed face down with their openings 37 facing the table and are secured in spaced apart positions on the table so that they are arranged in horizontal and vertical rows as shown in FIG. 1. After the box liners 26 have been bolted to the table in the desired locations, appropriate reinforcing is then placed over and between each of the box liners. By way of example, the reinforcing can take the form of U-shaped loops of No. 3 rebars 51, 52 and 53 which are positioned between the box liners 26. A back bolt anchor sleeve 56 is provided for use in the wall 12 and opens into one of the box-like recesses 21 to permit securing the wall 12 to an existing structure if desired. Additional reinforcing 57 formed of spaced apart pieces approximately 5 inches long extend from both sides of the anchor sleeve 56. Additional pieces of reinforcing 59 can be provided in the form of pieces 6 inches long of No. 3 rebar disposed between the box liners 26 and secured to angle iron members 61. The members 61 reinforce the corners of the wall 12 when completed and extend vertically and horizontally of the finished wall 12. A wire mesh 63 of a suitable type such as 4×4×8 gauge is supported over the top of the box liners 26. Star inserts 66 with plated washers 67 mounted at their proximal extremities are positioned at each of the four corners of the box liners 26 prior to pouring of the concrete mix so that they are retained within the reinforced concrete adjacent the corners of the box liners. A form (not shown) is then placed around the outer perimeter of the table to form an enclosure for the wall 12 while it is being poured. At least two lifting bolt anchors 62 are provided in opposite corners of the wall 12 to permit lifting of the wall.

Shortly prior to pouring the concrete mixture over the box liners 26, the exterior exposed surfaces of the box liners 26 are coated with an adhesive by suitable means, as for example a paint brush or a roller.

One adhesive found to be particularly suitable for the present application is a two-part adhesive identified as "Strentex" and ABS supplied by Wilbert, Inc. of Broadview, Illinois 60153. The two-part adhesive is mixed and applied to the desired thickness, as for example 4 to 5 mils, and is then allowed to cure. Within a period of approximately 30 to 45 minutes of curing at room temperature, the adhesive becomes very tacky. At this time, the concrete mix is poured into the form (not shown) over the reinforcing hereinbefore described and over the tops of the box liners 26 secured to the table to a depth so that the concrete mix extends above the wire mesh 63. A very high strength concrete mix is utilized, as for example what is considered to be a six sack mix to provide 8,000 psi concrete. In order to minimize chipping or cracking of the reinforced concrete, polypropylene in fiber form is added to the concrete in a suitable amount, as for example approximately five pounds of fibers for each cubic yard of concrete. These fibers are introduced at the batch plant for the concrete mix.

After pouring the concrete mix, the concrete mix is vibrated to remove air bubbles. The backside is then troweled to provide a smooth surface after the concrete has had its initial set. The concrete can then be left to cure overnight. The bolts holding down the box liners are removed, after which the reinforced concrete wall 12 can be lifted off the table by use of the bolt anchors 62. Thereafter, the reinforced concrete wall 12 with the box liners 26 therein can be shipped to any desired site for erection on an appropriate foundation.

The facade 46 can be mounted before or after shipment of the wall 12 to the erection site. The trim pieces 47 can be secured to the front surface 13 of the wall 12 by conventional means utilized for adhering marble. For example, a waterproof cement can be utilized. Alternatively, copper wire or other alternative techniques can be utilized for securing the trim pieces 47 to the wall 12. Removable individual marble shutters 48 for the box liners 26 are held in place by the rosettes 49 provided at each f the four corners of the box liners 26 and threaded into the washers 67 and star inserts 66.

When it is desired to deposit the cremated remains of an individual in an urn within the box liner 26, the shutter 48 can be removed by removal of the appropriate rosettes 49. The urn may then be placed in the box liner 26 and sealed within the box liner by bonding the security shutter 42 into the recess 36 of the box liner 26 by a suitable adhesive to provide an enclosed waterproof space or niche. Thereafter, the marble shutter 48 can be replaced by reinserting the rosettes 49.

From the foregoing it can be seen that a niche construction has been provided as well as a method for constructing the same, which makes it possible to provide a niche construction in which the box liners 26 cannot be removed by vandals without destruction of the box liner. Thus, there has been provided greatly improved security for cremation urns placed in the box liners. The very strong adhesive utilized between the box liner and the concrete prevents removal of the box liners without destruction of the box liners. In addition, the security shutter which is provided also makes it impossible to open the niche which is contained within the box liner 26 without destruction of the box liner. Various sizes of niches can be provided utilizing the same construction. By providing the appropriate facade, the niche constructions can be made so they are very attractive. The niche construction is also one which can be economically manufactured.

What is claimed is:

1. In a niche construction, a wall of reinforced concrete having a surface and having recesses formed therein which have openings which extend to the surface and having interior surfaces defining the recesses, a plurality of box liners of non-combustible plastic material having fiberglass fibers disposed therein, said box liners being disposed in said recesses and having exterior surfaces, and an adhesive adherent to said exterior surfaces of said box liners and to interior surfaces defining the recesses in said reinforced concrete forming a bond between the box liners and the reinforced concrete to prevent removal of the box liners from the recesses.

2. A niche construction as in claim 1 together with a security shutter formed of the same material as the box liner and means for bonding the security shutter to the box liner to provide a watertight and airtight enclosed niche within the box liner.

3. A niche construction as in claim 2 together with a removable facade mounted on said front wall.

4. A wall construction as in claim 1 wherein said adhesive is a two-part adhesive which includes a catalyst.

5. A method for fabricating a reinforced pre-cast concrete niche construction by the use of a table, providing box liners formed of a molded plastic reinforced with fiberglass and having open extremities and having exposed exterior surfaces, placing the box liners on the table with the open extremities facing the table and in spaced apart positions arranged in a predetermined pattern on the table, securing the box liners to the table, placing reinforcing between the box liners and over the box liners, applying adhesive to the exterior exposed surfaces of the box liners, permitting the adhesive to cure until the surface thereof becomes tacky, and pouring a concrete mix over the box liners and the reinforcing to form a layer of concrete overlying the box liners while the adhesive on the exterior surfaces of the box liners is still tacky, permitting the concrete mix to cure and lifting the reinforced concrete niche construction from the table to provide a wall which exposes the openings in the box liners and providing security shutters of the same material as the box liners and bonding the same to the box liners to form an airtight and watertight niches within the box liners.

6. A method as in claim 5 together with the step of placing a removable decorative facade on the front surface of the reinforced concrete wall.

7. A method as in claim 5 wherein said adhesive is permitted to cure for 30 to 45 minutes at room temperature before the concrete mix is placed thereon.

* * * * *